US011097750B2

(12) United States Patent
Conte et al.

(10) Patent No.: US 11,097,750 B2
(45) Date of Patent: Aug. 24, 2021

(54) CABLE TRANSPORTATION SYSTEM AND METHOD FOR TRANSPORTING PEOPLE OR GOODS AND CLAMP FOR A VEHICLE OF A CABLE TRANSPORTATION SYSTEM

(71) Applicant: Leitner S.p.A., Vipiteno (IT)

(72) Inventors: Giuseppe Conte, Bolzano (IT); Franco Coco, Laives (IT)

(73) Assignee: LEITNER S.P.A., Vipiteno (IT)

( * ) Notice: Subject to any disclaimer, the term of this patent is extended or adjusted under 35 U.S.C. 154(b) by 392 days.

(21) Appl. No.: 16/230,176

(22) Filed: Dec. 21, 2018

(65) Prior Publication Data

US 2019/0193756 A1 Jun. 27, 2019

(30) Foreign Application Priority Data

Dec. 22, 2017 (IT) ..... 102017000149393

(51) Int. Cl.

| | |
|---|---|
| ***B61B 12/12*** | (2006.01) |
| ***B61B 9/00*** | (2006.01) |
| ***B61F 5/52*** | (2006.01) |
| ***B61F 9/00*** | (2006.01) |
| ***B61B 11/00*** | (2006.01) |

(52) U.S. Cl.

CPC ..... *B61B 12/127* (2013.01); *B61B 9/00* (2013.01); *B61B 11/00* (2013.01); *B61B 12/125* (2013.01); *B61F 5/52* (2013.01); *B61F 9/00* (2013.01)

(58) Field of Classification Search

CPC ..... B61B 12/127; B61B 12/125; B61B 9/00; B61B 11/00; B61F 5/52; B61F 9/00

See application file for complete search history.

(56) References Cited

U.S. PATENT DOCUMENTS 3,871,303 A * 3/1975 Woodling ..... B61B 12/105 104/173.1
4,092,929 A * 6/1978 Laurent ..... B61B 12/125 104/173.1

(Continued)

FOREIGN PATENT DOCUMENTS

| | | |
|---|---|---|
| CH | 692 732 | 10/2002 |
| EP | 1 193 153 | 4/2002 |

(Continued)

OTHER PUBLICATIONS

Italian Search Report for Italian Application No. 201700149393, dated Sep. 3, 2018 (8 pages).

*Primary Examiner* — Jason C Smith

(74) *Attorney, Agent, or Firm* — Neal, Gerber & Eisenberg LLP

(57) ABSTRACT

A cable transportation system for transporting people or goods defines an advancing path extending between two end stations and having a designated length L, and has a hauling cable looped into a closed ring and having a forward branch and a return branch, which extend between the end stations; at least one vehicle configured to be alternately advanced between the two end stations, and selectively and alternately clamped to the forward branch and the return branch of the hauling cable at the end stations; and a drive member for advancing the hauling cable along the advancing path and selectively stopping the hauling cable when the vehicle clamped to the hauling cable is at one end station.

36 Claims, 4 Drawing Sheets

(56) References Cited

U.S. PATENT DOCUMENTS 4,848,241 A * 7/1989 Kunczynski ..... B61B 7/04 104/173.1
5,419,261 A * 5/1995 Tarassoff ..... B61B 9/00 104/173.1
5,517,923 A * 5/1996 Cathiard ..... B61B 13/12 104/173.1
5,595,122 A * 1/1997 Levi ..... B61B 9/00 104/173.1
6,321,657 B1 * 11/2001 Owen ..... B61B 1/02 104/119
8,375,866 B2 * 2/2013 Heinzle ..... B61B 12/125 104/202
8,418,625 B2 * 4/2013 Czaloun ..... B61B 12/125 104/204
9,284,127 B2 * 3/2016 Heinsohn ..... B65G 37/02
10,864,924 B2 * 12/2020 Richard ..... B61B 13/125
2010/0180792 A1 * 7/2010 Bavaresco ..... B60R 16/0307 104/178
2010/0294162 A1 * 11/2010 Durante ..... B61B 12/04 104/173.1
2011/0226152 A1 * 9/2011 Mollet ..... B61B 12/125 104/178
2012/0090496 A1 * 4/2012 Conte ..... B61B 9/00 104/130.01
2013/0054057 A1 * 2/2013 Sonnerer ..... H02K 11/21 701/19
2014/0238260 A1 * 8/2014 Conte ..... E01B 25/15 104/130.01
2014/0305331 A1 * 10/2014 Bavaresco ..... B61F 5/22 104/173.1
2019/0193755 A1 * 6/2019 Conte ..... B61B 9/00
2019/0193756 A1 * 6/2019 Conte ..... B61B 11/00
2019/0375432 A1 * 12/2019 Erharter ..... B61B 12/02
2021/0031811 A1 * 2/2021 Erharter ..... B61B 7/06

FOREIGN PATENT DOCUMENTS

EP 1193153 A1 * 4/2002 ..... B61B 9/00
EP 2 684 756 1/2014

* cited by examiner

CABLE TRANSPORTATION SYSTEM AND METHOD FOR TRANSPORTING PEOPLE OR GOODS AND CLAMP FOR A VEHICLE OF A CABLE TRANSPORTATION SYSTEM

PRIORITY CLAIM

This application claims the benefit of and priority to Italian Patent Application No. 102017000149393, filed on Dec. 22, 2017, the entire disclosure of which is incorporated herein by reference.

TECHNICAL FIELD

The present disclosure relates to a cable transportation system configured to transport people and/or goods.

BACKGROUND

In particular, the present disclosure relates to a cable transportation system extending between two end stations and typically defined as "back-and-forth". The cable transportation system comprises at least one vehicle that is alternately advanced between the end stations in opposite directions by a hauling cable.

In this type of cable transportation systems, the direction of advancement of the vehicle must be reversed every time the vehicle reaches one of the two end stations. A known method for reversing the direction of the vehicle at the end stations consists in stopping the hauling cable and the vehicle clamped to the hauling cable at the end station and reversing the direction of advancement of the hauling cable, and consequently the direction of advancement of the vehicle. Although this motion reversal method is relatively simple because the vehicle is constantly clamped to the hauling cable, the cyclical motion reversal requires that such cable transportation systems can only move two separate vehicles, which necessarily travel in opposite directions between the two end stations.

SUMMARY

One object of the present disclosure is to provide a cable transportation system, which is free from certain of the drawbacks of certain of the prior art.

In accordance with the present disclosure, there is provided a cable transportation system configured to transport people and/or goods, the cable transportation system comprising:

an advancing path extending between two end stations and having a designated length L;

a hauling cable looped into a closed ring and having a forward branch and a return branch, which extend between the end stations; and at least one vehicle configured to be alternately advanced between the two end stations, and selectively and alternately clamped to the forward branch and the return branch of the hauling cable at the end stations;

a drive member configured to advance the hauling cable along the advancing path and selectively stopping the hauling cable when the vehicle clamped to the hauling cable is at one end station.

In accordance with the present disclosure, the hauling cable is advanced in the same direction of advancement.

The system comprises a single lane between the end stations along most of the advancing path.

In general, the system comprises a number N of vehicles operating along the advancing path, and a number N−1 of local lane redoublings between the end stations; the end stations and the redoublings being distributed with a constant pitch along the advancing path.

Under certain conditions, it is therefore possible to provide a system with a plurality of vehicles operating simultaneously, and in this case it is advantageous to provide a stop station at each lane redoubling.

In accordance with the present disclosure, the forward branch and the return branch are parallel to each other and arranged side by side at each end station. This solution facilitates the release of one of the forward branch and the return branch, as well as the subsequent clamping of one of the forward branch and the return branch.

In particular, the vehicle comprises a frame; at least one clamp, which is arranged underneath the frame and mounted on the frame in a selectively rotatable manner about a rotation axis and comprises two jaws arranged on one side of the rotation axis and configured for selectively clamping and releasing the hauling cable; a control member, which is configured for opening and closing the jaws and arranged on the opposite side of the jaws with respect to the rotation axis; and an actuator configured to selectively rotate the clamp about the rotation axis between two working positions arranged at 180° from each other.

The rotating clamp enables the jaws of the clamp to be arranged at the forward branch and the return branch of the hauling cable, and hence the direction of advancement of the vehicle to be reversed.

In particular, the control member of the clamp is arranged at a distance from the rotation axis shorter than the distance of the jaws from the rotation axis. In other words, in a plan view, the control member is arranged between the forward branch and the return branch and does not interfere with the hauling cable in any position assumed by the clamp.

In particular, the actuator is configured to rotate the clamp about the rotation axis in one of two opposite directions so that in each working position the clamp abuts against a respective abutment.

In particular, the vehicle comprises a bogie, said clamp being mounted on the bogie. From the constructional point of view, the bogie has a solid frame capable of housing a large shaft and transmitting the traction force to the vehicle.

In particular, the system comprises, at each end station, a control device configured to open and close the jaws when the vehicle is stationary and the clamp is arranged in either of the two working positions. In practice, this is a control device with a predefined position, whereby the vehicle is stopped in order to arrange the clamp at the control device.

In greater detail, the control device comprises a first control mechanism configured to cooperate with the control member when the clamp is in the first working position; and a second control mechanism configured to cooperate with the control member when the clamp is in the second working position. The two mechanisms are actuated independently to guarantee relative maximum flexibility of the system.

In particular, each control mechanism is selectively moveable between a rest position, in which that control mechanism does not cooperate with the clamp, and a working position, in which that control mechanism cooperates with the control member of the clamp. In this way, the jaws of the clamp can be selectively opened and closed.

In accordance with the present disclosure, the system comprises, at each end station, a spacing device for the forward branch and a spacing device for the return branch for pulling out the hauling cable from the open jaws and allowing the rotation of the clamp about the rotation axis at each end station, and inserting the hauling cable between the open jaws. In this way, the hauling cable can be selectively under the bulk of the clamp.

In practice, the spacing device comprises two rollers configured to selectively raise and lower a section of the hauling cable.

A further object of the present disclosure is to provide a cable transportation method for transporting people and/or goods, which is free from certain of the drawbacks of certain of the prior art.

In accordance with the present disclosure, there is provided a cable transportation method for transporting people or goods, the method comprising the steps of: alternately advancing at least one vehicle along an advancing path extending between two end stations and having a designated length L; advancing a hauling cable along the advancing path; selectively stopping the hauling cable when the vehicle clamped to the hauling cable is at an end station; and selectively and alternately clamping the vehicle to the forward branch and the return branch of the hauling cable at the end stations. In this way, the vehicle may be alternately advanced between the two end stations, while the cable is advanced in the same direction.

In particular, the method comprises guiding the forward branch and the return branch so as to keep the forward branch and the return branch parallel to each other and arranged side by side at least at the end stations.

The particular position of the forward and return branches facilitates the release of one of the forward branch and the return branch, as well as the subsequent clamping to one of the forward branch and the return branch.

In particular, the method comprises selectively rotating a clamp about a rotation axis with respect to a frame of the vehicle for selectively arranging the jaws of the clamp at the forward branch, in a first working position, and at the return branch, in a second working position.

In accordance with the present disclosure, a single clamp is sufficient to clamp the vehicle to the forward branch and the return branch.

In particular, the method comprises opening and closing the jaws at each end station and in both working positions of the clamp.

The opening of the clamp requires control devices arranged at the end stations.

In accordance with the present disclosure, the method comprises spacing the hauling cable and the clamp apart and allowing the rotation of the clamp about the rotation axis at each end station.

The present disclosure also relates to a clamp for a vehicle of a cable transportation system, which is free from certain of the drawbacks of certain of the prior art.

In accordance with the present disclosure, there is provided a clamp for a vehicle of a cable transportation system, the clamp being configured to be arranged underneath a frame of a vehicle and mounted on the frame in a selectively rotatable manner about a rotation axis and comprising two jaws arranged on one side of the rotation axis and configured for selectively releasing and clamping at least one hauling cable; a control member, which is configured for opening and closing the jaws and arranged on the opposite side of the jaws with respect to the rotation axis; and an actuator configured to selectively rotate the clamp about the rotation axis between two working positions arranged at 180° from each other. In this way, the vehicle may be connected to a forward branch and a return branch of the same cable or to two parallel branches of two respective cables.

Additional features are described in, and will be apparent from the following Detailed Description and the figures.

BRIEF DESCRIPTION OF THE DRAWINGS

Further features and advantages of the present disclosure will be apparent from the following description of non-limiting embodiments thereof, with reference to the figures of the accompanying drawings, wherein.

DETAILED DESCRIPTION

Figure 1:
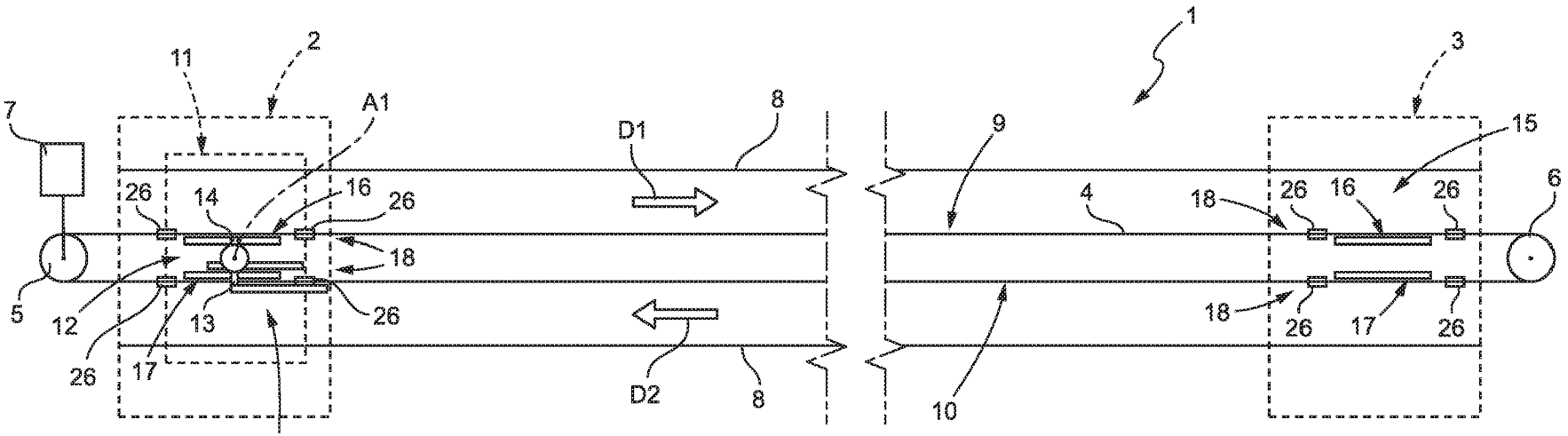
FIGS. 1 to 3 are schematic plan views, with parts removed for clarity, of a first embodiment of a cable transportation system constructed in accordance with the present disclosure.
Figure 2:
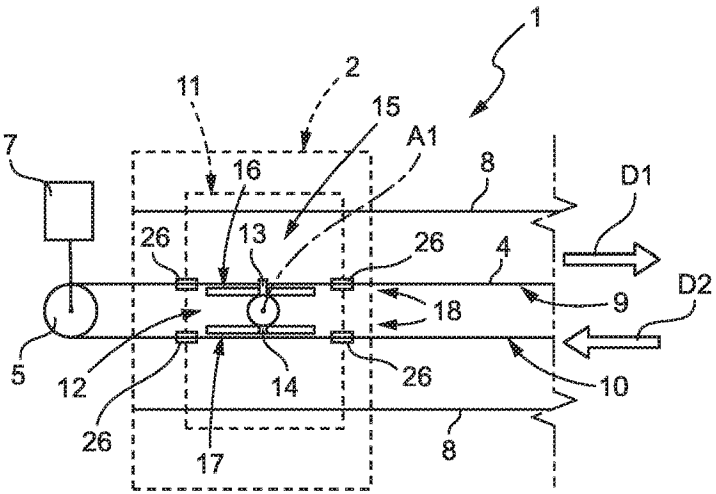
Figure 3:
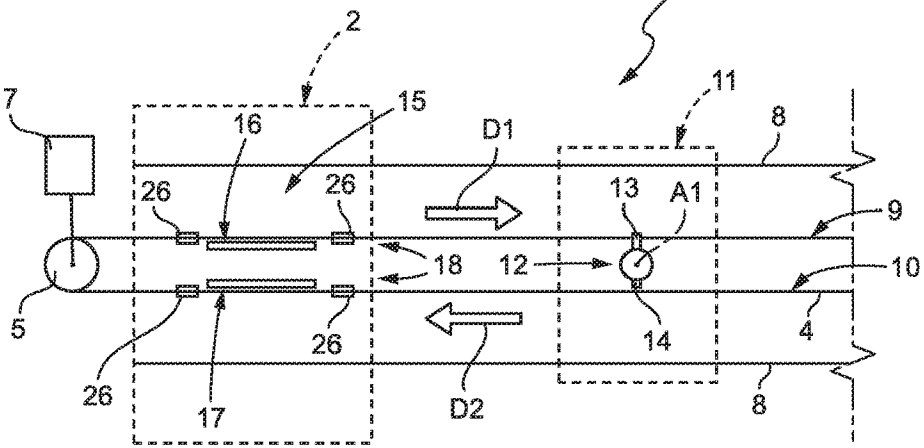

With reference now to the example embodiments of the present disclosure illustrated in FIGS. 1 to 11, and more specifically with references to FIGS. 1 to 3, the numeral 1 indicates, as a whole, a cable transportation system of the "back-and-forth" type.

With reference to FIG. 1, the system 1 extends along a predetermined path P between two end stations 2 and 3 and comprises a hauling cable 4 looped into a ring about a drive pulley 5 and a return pulley 6 arranged at the end stations 2 and 3, respectively. The drive pulley 5 is actuated by a drive member 7, in this case a permanent-magnet synchronous electric motor.

The system 1 has a single lane between the two end stations 2 and 3 and comprises two parallel rails 8, which extend from the end station 2 to the end station 3 and, together with the hauling cable 4, define the lane.

The hauling cable 4 is arranged between the rails 8 and defines, along the lane, a forward branch 9 and a return branch 10, which are guided so as to be substantially parallel to each other and arranged side by side along the lane.

The system 1 comprises a vehicle 11, which is configured to be advanced along the rails 8 by the hauling cable 4 in a direction D1 and in direction D2 opposite to direction D1. The vehicle 11 is configured to be selectively and alternately clamped to the forward branch 9 and the return branch 10 of the hauling cable 4 when the vehicle 11 is stationary at the end stations 2 and 3 by a clamp 12.

In the example shown, the clamp 12 is mounted on the vehicle 11 rotatable about a rotation axis A1 and has two jaws 13, which are offset with respect to the rotation axis A1. The extent of the offset of the jaws 13 with respect to the rotation axis A1 is equal to half the distance of the plan-view projection of the forward branch 9 and the return branch 10 at the end stations 2 and 3. Furthermore, the rotation axis A1 of the clamp 12 is equidistant from the forward branch 9 and the return branch 10 of the hauling cable 4. In this way, the jaws 13 at the forward branch 9, by a 180° rotation of the clamp 12, are arranged at the return branch 10 and vice versa.

The clamp 12 comprises a control member 14, which is configured for opening and closing the jaws 13, arranged on the opposite side of the jaws 13 with respect to the rotation axis A1, and offset with respect to the rotation axis A1 by a significantly smaller extent than the extent of the offset of the jaws 13. In other words, in a plan view, the control member 14 is within the area delimited by the return branch 9 and the forward branch 9 of the hauling cable 4.

The system 1 comprises, at each end station 2 and 3, a control device 15 configured to open and close the clamp 12 in both working positions of the clamp 12 when the vehicle 11 is stationary at an end station 2 and 3. The control device 15 comprises a control mechanism 16 configured to cooperate with the control member 14 when the clamp 12 is in the first working position; and a second control mechanism 17 configured to cooperate with the control member 14 when the clamp 12 is in the second working position. Each mechanism 16 and 17 is selectively moveable between a rest position, in which mechanism does not cooperate with the clamp 12, and a working position, in which mechanism cooperates with the clamp 12, in particular with the control member 14 of the clamp 12.

The system 1 comprises, at each end station 2 and 3, two spacing devices 18 at the clamp 12 for spacing the sections of the hauling cable 4 at the clamp 12 and allowing the rotation of the clamp 12 about the rotation axis A1 at each end station 2 and 3.

Figure 4:
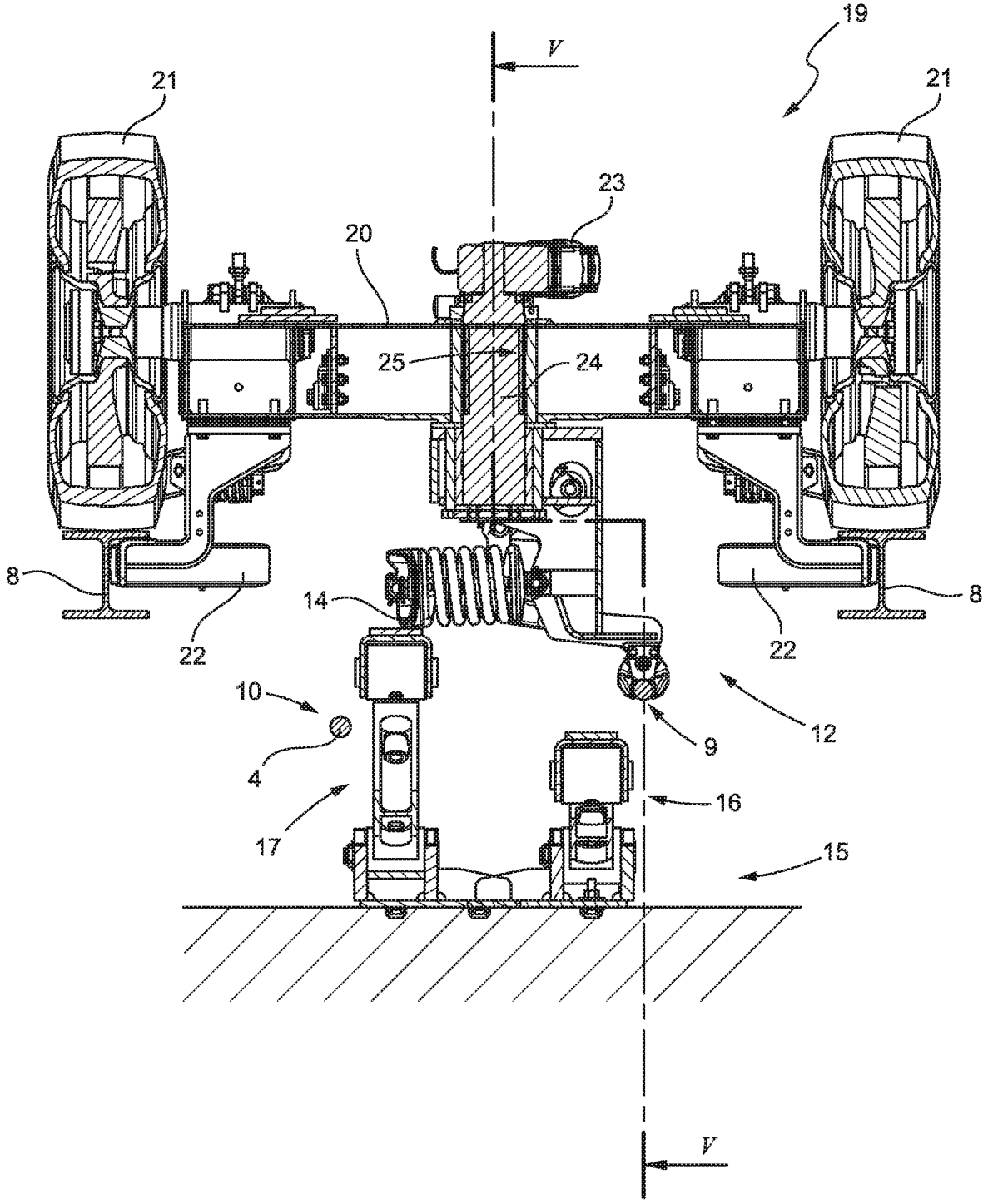
FIG. 4 is a cross-sectional view in enlarged scale, with parts in section and parts removed for clarity, of a detail of the system object of the present disclosure.

With reference to FIG. 4, the vehicle 11 comprises a bogie 19, which is configured to be advanced along the rails 8 and comprises a frame 20; a plurality of supporting wheels 21 suitable to roll on the upper face of the rails 8; and a plurality of guide wheels 22 suitable to roll along the inner faces of the rails 8.

In an alternative embodiment of the present disclosure, the supporting wheels 21 are replaced with air cushions (not shown in the figures).

The frame 20 supports the clamp 12 rotatably about the rotation axis A1 and an actuator 23 to rotate the clamp 12 in opposite directions about the rotation axis A1 so as to cause the clamp 12 in each working position to abut against a respective abutment (not shown in the figures). The clamp 12 is arranged under the frame 20, while the actuator 23 is arranged above the frame 20 and connected to the clamp 12 by a shaft 24 housed in a seat 25 of the frame 20.

The control device 15 is positioned under the hauling cable 4 and comprises two actuators 26 and 27, which control the respective control mechanisms 16 and 17 independently of each other. Each of the control mechanisms 16 and 17 comprises a pantograph, which is movable between a lowered, rest position, in which it does not interfere with the clamp 12, and a raised, working position, in which it raises the control member 14 of the clamp 12 and opens the jaws 13. Each of the control mechanisms 16 and 17 comprises a respective actuator (not shown in the figures).

Figure 5:
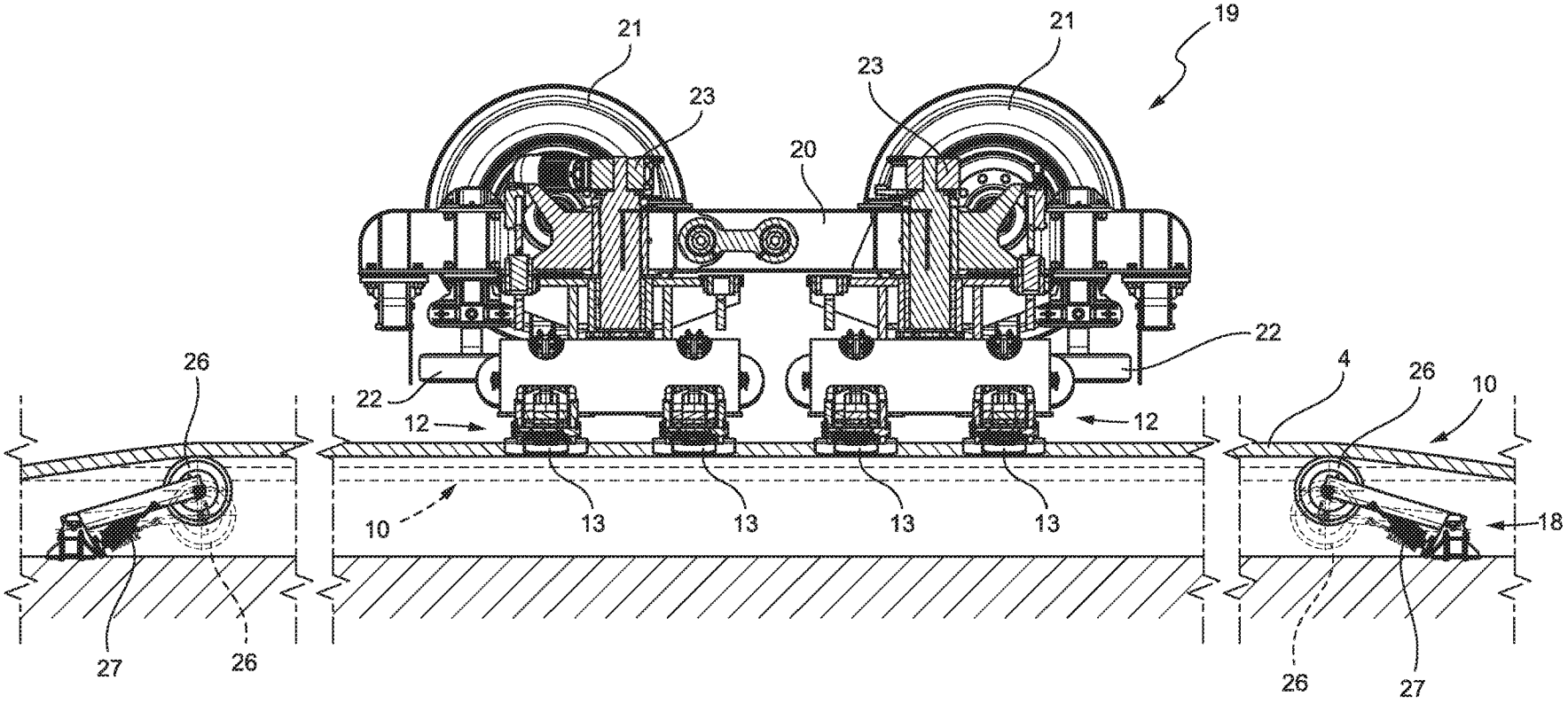
FIG. 5 is an enlarged-scale view in longitudinal section, with parts in section and parts removed for clarity, of a detail of the system object of the present disclosure.
Figure 6:
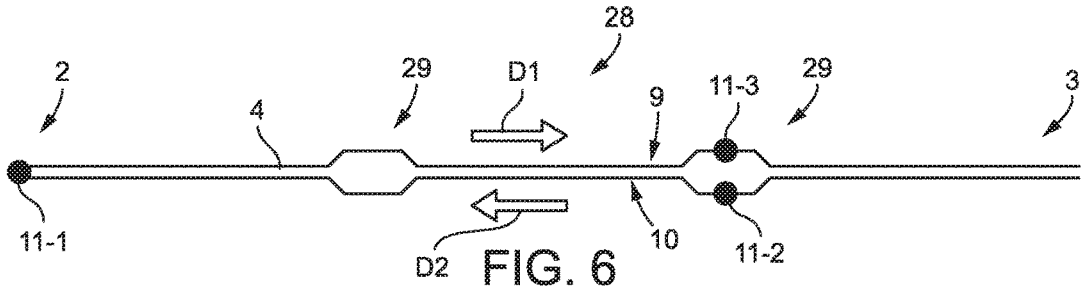
FIGS. 6 to 11 are schematic plan views, with parts removed for clarity, of a second embodiment of the cable transportation system constructed in accordance with the present disclosure.
Figure 7:
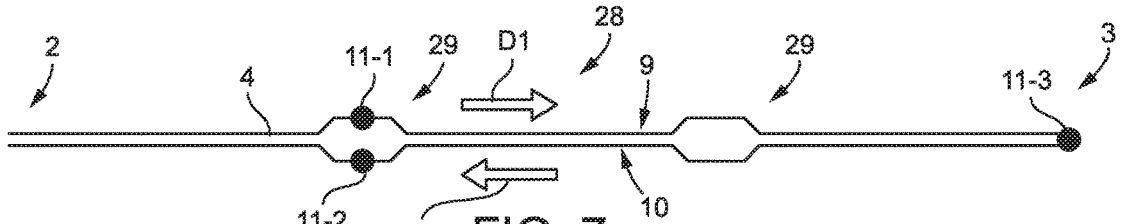
Figure 8:
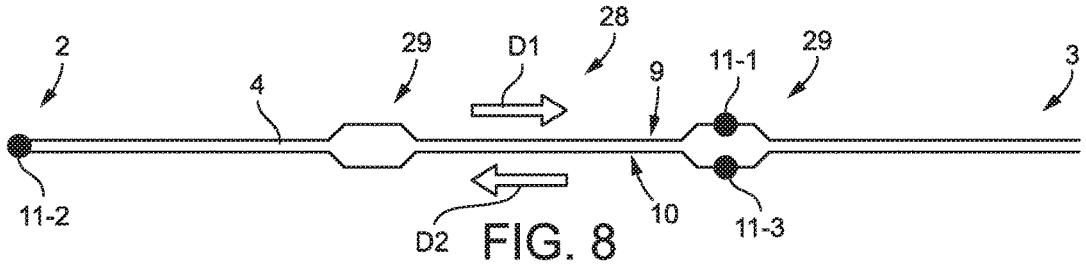
Figure 9:
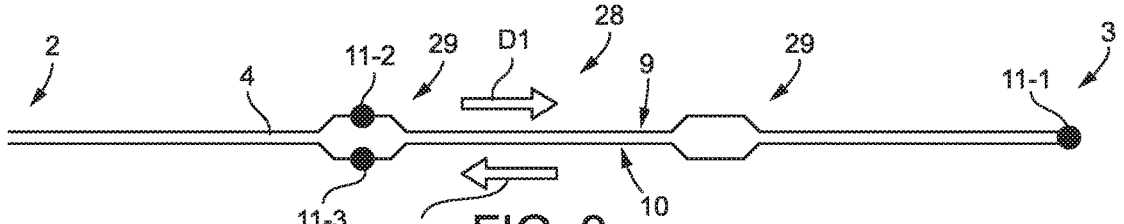
Figure 10:
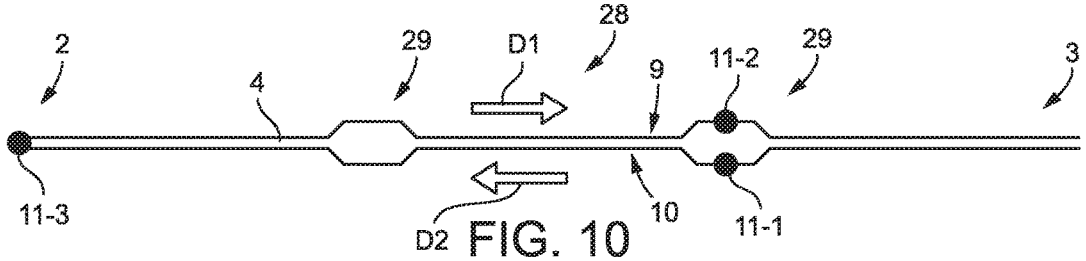
Figure 11:
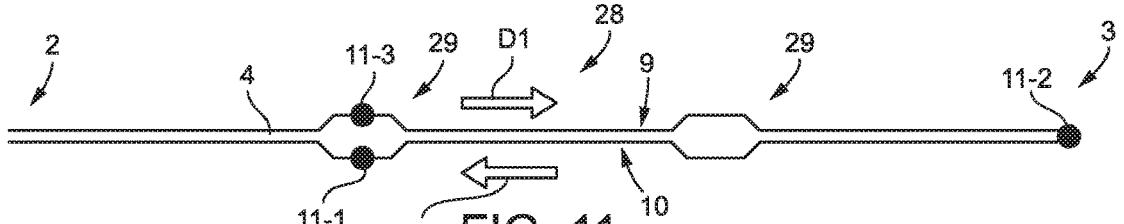

With reference to FIG. 5, each spacing device 18 comprises two rollers 26, which are movable between a lowered position, indicated by a broken line, and a raised position, indicated by a solid line, and two actuators 27 configured to control the position of the respective rollers 26.

The vehicle 11 is clamped to the hauling cable 4 by at least two clamps 12. In FIG. 5, the two clamps 12 are mounted on the same bogie 19, are aligned along the longitudinal length of the vehicle 11 and are both rotatably mounted on the frame 20 of the bogie 19. When the two clamps 12 are arranged at a close distance from each other, as in the case illustrated in FIG. 5, the rotation of the clamps 12 is simultaneous. Accordingly, the system comprises a single control device 15 for both clamps 12 and two spacing devices 18 for both clamps 12.

When two clamps 12 of the vehicle 11 are arranged at a relatively great distance from each other, the two clamps 12 are actuated in succession so that the vehicle 11 is constantly clamped to the hauling cable 4. In this case, each end station 2 and 3 requires one control device 15 for each clamp 12 and two spacing devices 18 for each clamp 12.

The system 1 comprises a control unit 28, which controls the drive member 7, the control device 15, the actuators 23 configured to rotate the clamps 12; and the spacing devices 18 in accordance with the operating modes of the system 1 as described below.

In use, and with reference to FIG. 1, the vehicle 11 enters and stops at the station 2 clamped to the hauling cable 4 along the return branch 10. In the station 2, both the control mechanisms 16 and 17 are in the lowered position, while the rollers 26 along the return branch 10 are raised and the rollers 26 along the forward branch 9 are lowered. The raising of the control mechanism 16 causes the opening of the jaws 13. The subsequent lowering of the rollers 26 along the return branch 10 places the hauling cable 4 outside the bulk of the clamp 12. The subsequent lowering of the control mechanism 16 causes the closing of the jaws 13, and the clamp 12 is free to rotate about the rotation axis A1. The clamp 12 is rotated by 180° so as to arrange the jaws 13 above the forward branch 9 of the hauling cable 4, as shown in FIG. 2. The raising of the control mechanism 17 causes the opening of the jaws 13, while the subsequent raising of the rollers 26 along the forward branch 9 causes the insertion of a portion of the forward branch 9 between the jaws 13. The subsequent lowering of the control mechanism 17 causes the clamping of the jaws 13 to the forward branch 9. In this configuration of the system 1, the hauling cable 4 is advanced and the vehicle 11 advances along the path P in direction D1, as shown in FIG. 3.

With reference to FIGS. 6 to 11, the reference numeral 28 designates a cable transportation system of the "back-and-forth" type, which comprises all the components of the system 1 described with reference to the preceding figures. The system 28 differs from the system 1 in that system 28 comprises two local redoublings 29 of the single lane and three vehicles 11 operating simultaneously in the system. For greater understanding of the figures from 6 to 7, the vehicles 11 are indicated with the numbers 11-1, 11-2 and 11-3 so as to be able to distinguish them from each other.

The local lane redoubling 29 requires points (not shown in the figures), and cable switches (also not shown in the figures).

The end stations 2 and 3 and the redoublings 29 of the lane are distributed with a constant pitch so that a stop of a vehicle 11 at the end stations 2 and 3 corresponds to a stop of the other two vehicles 11 at the redoublings 29 of the lane, which can be equipped to be intermediate loading and unloading stations. The number of vehicles 11 depends on the number of lane redoublings 29. A number N of vehicles 11 operating along the path P requires N−1 lane redoublings 29.

Lastly, it is clear that modifications and variations may be made to the cable transportation system described and claimed herein without however departing from the scope of protection defined by the appended claims. For example, the clamp could be used to selectively connect the vehicle to two parallel cables, in cable transportation systems with at least two hauling cables. As such, the present disclosure also covers embodiments not described in the detailed description and equivalent embodiments that fall within scope of the appended claims. Accordingly, various changes and modifications to the presently disclosed embodiments will be apparent to those skilled in the art. Such changes and modifications can be made without departing from the spirit and scope of the present subject matter and without diminishing its intended technical scope. It is therefore intended that such changes and modifications be covered by the appended claims.

The invention claimed is:

1. A cable transportation system comprising:

two end stations wherein an advancing path having a designated length extends between the two end stations;

a single hauling cable looped into a closed ring and having a forward branch and a return branch which extend between the two end stations;

a vehicle configured to be:

alternately advanced between the two end stations, and selectively and alternately clamped to:

the forward branch of the single hauling cable at one of the two end stations, and the return branch of the single hauling cable at the other of the two end stations; and a drive member configured to:

advance the single hauling cable along the advancing path, and selectively stop the single hauling cable when the vehicle clamped to the single hauling cable is at one of the two end stations.

2. The cable transportation system of claim 1, wherein the forward branch and the return branch are parallel to each other and arranged side by side at each of the two end stations.

3. The cable transportation system of claim 1, wherein the vehicle comprises:

a frame;

a clamp arranged underneath the frame and selectively rotatably mounted on the frame about a rotation axis, the clamp comprising two jaws arranged on one side of the rotation axis and configured to selectively release and clamp the single hauling cable;

a control member configured to cause the two jaws of the clamp to open and close and arranged on an opposite side of the two jaws of the clamp with respect to the rotation axis; and an actuator configured to selectively rotate the clamp about the rotation axis between two working positions arranged at 180° from each other.

4. The cable transportation system of claim 3, further comprising, at each of the two end stations, a spacing device for the forward branch and a spacing device for the return branch for pulling out the single hauling cable from the two open jaws, enabling the rotation of the clamp about the rotation axis at that end station, and inserting the single hauling cable between the two open jaws.

5. The cable transportation system of claim 4, wherein each spacing device comprises two rollers configured to selectively raise and lower a section of the single hauling cable.

6. The cable transportation system of claim 1, wherein the vehicle comprises a bogie and a clamp mounted on the bogie.

7. A cable transportation method comprising:

alternately advancing a vehicle along an advancing path having a designated length and extending between two end stations;

advancing a single hauling cable along the advancing path;

selectively stopping the single hauling cable when the vehicle clamped to the single hauling cable is at one of the two end stations; and selectively and alternately clamping the vehicle to a forward branch and a return branch of the single hauling cable at the two end stations.

8. The method of claim 7, further comprising guiding the forward branch and the return branch to keep the forward branch and the return branch parallel to each other and arranged side by side at at least the two end stations.

9. The method of claim 7, further comprising selectively rotating a clamp about a rotation axis with respect to a frame of the vehicle for selectively arranging two jaws of the clamp at the forward branch in a first working position, and at the return branch in a second working position.

10. The method of claim 9, further comprising opening and closing the jaws at each of the two end stations and in both working positions of the clamp.

11. The method of claim 9, further comprising spacing the single hauling cable and the clamp apart and enabling the rotation of the clamp about the rotation axis at each of the two end stations.

12. A cable transportation system vehicle clamp configured to be arranged underneath a frame and selectively rotatably mountable on the frame about a rotation axis, the cable transportation system vehicle clamp comprising:

two jaws arrangeable on one side of the rotation axis and configured for selectively releasing and clamping a hauling cable;

a control member configured to cause the two jaws to open and close and arrangeable on an opposite side of the two jaws with respect to the rotation axis; and an actuator configured to selectively rotate at least the two jaws about the rotation axis between two working positions arranged at 180° from each other.

13. The cable transportation system vehicle clamp of claim 12, wherein the control member is arrangeable at a distance from the rotation axis less than a distance of the two jaws from the rotation axis.

14. The cable transportation system vehicle clamp of claim 13, wherein the actuator is configured to rotate at least the two jaws about the rotation axis in two opposite directions.

15. The cable transportation system vehicle clamp of claim 14, wherein the actuator is connected by a shaft housed in a seat of the frame.

16. A cable transportation system comprising:

two end stations wherein an advancing path having a designated length extends between the two end stations and a single lane is defined between the two end stations;

a plurality of local lane redoublings between the two end stations, wherein the two end stations and the lane redoublings are distributed with a constant pitch along the advancing path;

a hauling cable looped into a closed ring and having a forward branch and a return branch which extend between the two end stations;

a plurality of vehicles operating along the advancing path, wherein each of the vehicles is configured to be:

alternately advanced between the two end stations, and selectively and alternately clamped to:

the forward branch of the hauling cable at one of the two end stations, and the return branch of the hauling cable at the other of the two end stations; and a drive member configured to:

advance the hauling cable along the advancing path, and selectively stop the hauling cable when at least one of the plurality of vehicles is clamped to the hauling cable at one of the two end stations.

17. The cable transportation system of claim 16, further comprising a stop station at each lane redoubling.

18. The cable transportation system of claim 16, wherein the forward branch and the return branch are parallel to each other and arranged side by side at each of the two end stations.

19. The cable transportation system of claim 16, wherein each of the plurality of vehicles comprises:

a frame;

a clamp arranged underneath the frame and selectively rotatably mounted on the frame about a rotation axis, the clamp comprising two jaws arranged on one side of the rotation axis and configured to selectively release and clamp the hauling cable;

a control member configured to cause the two jaws of the clamp to open and close and arranged on an opposite side of the two jaws of the clamp with respect to the rotation axis; and an actuator configured to selectively rotate the clamp about the rotation axis between two working positions arranged at 180° from each other.

20. The cable transportation system of claim 19, further comprising, at each of the two end stations, a spacing device for the forward branch and a spacing device for the return branch for pulling out the hauling cable from the two open jaws, enabling the rotation of the clamp about the rotation axis at that end station, and inserting the hauling cable between the two open jaws.

21. The cable transportation system of claim 20, wherein each spacing device comprises two rollers configured to selectively raise and lower a section of the hauling cable.

22. The cable transportation system of claim 16, wherein at least one of the plurality of vehicles comprises a bogie and a clamp mounted on the bogie.

23. A cable transportation system comprising:

two end stations wherein an advancing path having a designated length extends between the two end stations;

a hauling cable looped into a closed ring and having a forward branch and a return branch which extend between the two end stations;

a vehicle comprising:

a frame, a clamp arranged underneath the frame and selectively rotatably mounted on the frame about a rotation axis, the clamp comprising two jaws arranged on one side of the rotation axis and configured to selectively release and clamp the hauling cable, a control member arranged at a distance from the rotation axis less than a distance of the two jaws from the rotation axis, the control member configured to cause the two jaws of the clamp to open and close and arranged on an opposite side of the two jaws of the clamp with respect to the rotation axis, and an actuator configured to selectively rotate the clamp about the rotation axis between two working positions arranged at 180° from each other, wherein the vehicle is configured to be:

alternately advanced between the two end stations, and selectively and alternately clamped to:

the forward branch of the hauling cable at one of the two end stations, and the return branch of the hauling cable at the other of the two end stations; and a drive member configured to:

advance the hauling cable along the advancing path, and selectively stop the hauling cable when the vehicle clamped to the hauling cable is at one of the two end stations.

24. The cable transportation system of claim 23, wherein the actuator is configured to rotate the clamp about the rotation axis in two opposite directions.

25. The cable transportation system of claim 23, wherein the forward branch and the return branch are parallel to each other and arranged side by side at each of the two end stations.

26. The cable transportation system of claim 23, further comprising, at each of the two end stations, a spacing device for the forward branch and a spacing device for the return branch for pulling out the hauling cable from the two open jaws, enabling the rotation of the clamp about the rotation axis at that end station, and inserting the hauling cable between the two open jaws.

27. The cable transportation system of claim 26, wherein each spacing device comprises two rollers configured to selectively raise and lower a section of the hauling cable.

28. The cable transportation system of claim 23, wherein the vehicle comprises a bogie and the clamp is mounted on the bogie.

29. A cable transportation system comprising:

two end stations wherein an advancing path having a designated length extends between the two end stations;

a hauling cable looped into a closed ring and having a forward branch and a return branch which extend between the two end stations;

a vehicle comprising:

a frame, a clamp arranged underneath the frame and selectively rotatably mounted on the frame about a rotation axis, the clamp comprising two jaws arranged on one side of the rotation axis and configured to selectively release and clamp the hauling cable, a control member configured to cause the two jaws of the clamp to open and close and arranged on an opposite side of the two jaws of the clamp with respect to the rotation axis, and an actuator configured to selectively rotate the clamp about the rotation axis between two working positions arranged at 180° from each other, wherein the vehicle is configured to be:

alternately advanced between the two end stations, and selectively and alternately clamped to:

the forward branch of the hauling cable at one of the two end stations, and the return branch of the hauling cable at the other of the two end stations;

at each of the two end station, a control device configured to open and close the two jaws of the clamp of the vehicle when the vehicle is stationary and the clamp of the vehicle is arranged in either of the two working positions, the control device comprising a first control mechanism configured to cooperate with the control member of the vehicle when the clamp of the vehicle is in a first of the working positions, and a second control mechanism configured to cooperate with the control member of the vehicle when the clamp of the vehicle is in a second of the working positions, wherein each control mechanism is selectively moveable between a rest position in which that control mechanism does not cooperate with the clamp of the vehicle, and a working position in which that control mechanism cooperates with the control member of the vehicle and the clamp of the vehicle; and a drive member configured to:

advance the hauling cable along the advancing path, and selectively stop the hauling cable when the vehicle clamped to the hauling cable is at one of the two end stations.

30. The cable transportation system of claim 29, wherein the forward branch and the return branch are parallel to each other and arranged side by side at each of the two end stations.

31. The cable transportation system of claim 30, wherein each spacing device comprises two rollers configured to selectively raise and lower a section of the hauling cable.

32. The cable transportation system of claim 29, further comprising, at each of the two end stations, a spacing device for the forward branch and a spacing device for the return branch for pulling out the hauling cable from the two open jaws, enabling the rotation of the clamp about the rotation axis at that end station, and inserting the hauling cable between the two open jaws.

33. The cable transportation system of claim 29, wherein the vehicle comprises a bogie and the clamp is mounted on the bogie.

34. A cable transportation method comprising:

alternately advancing a vehicle along an advancing path having a designated length and extending between two end stations;

advancing a hauling cable along the advancing path;

selectively stopping the hauling cable when the vehicle clamped to the hauling cable is at one of the two end stations;

selectively rotating a clamp about a rotation axis with respect to a frame of the vehicle for selectively arranging two jaws of the clamp at a forward branch of the hauling cable in a first working position, and at a return branch of the hauling cable in a second working position; and selectively and alternately clamping the vehicle to the forward branch and the return branch of the hauling cable at the two end stations.

35. The method of claim 34, further comprising opening and closing the jaws at each of the two end stations and in both working positions of the clamp.

36. The method of claim 34, further comprising spacing the hauling cable and the clamp apart and enabling the rotation of the clamp about the rotation axis at each of the two end stations.

* * * * *